United States Patent [19]

Luce et al.

[11] 4,352,311

[45] Oct. 5, 1982

[54] SYNTHESIZER PRESET EDITING TECHNIQUES

[75] Inventors: David A. Luce, Clarence Center; James Scott, Trumansburg, both of N.Y.

[73] Assignee: Norlin Industries, Inc., White Plaines, N.Y.

[21] Appl. No.: 152,431

[22] Filed: May 22, 1980

Related U.S. Application Data

[63] Continuation of Ser. No. 921,786, Jul. 3, 1978, abandoned.

[51] Int. Cl.[3] ..... G10H 1/06

[52] U.S. Cl. ..... 84/1.19; 84/1.11; 84/477 R

[58] Field of Search ..... 84/1.01, 1.11–1.13, 84/1.19, 1.21, 1.24–1.27, 464 R, 464 A, 477 R

[56] References Cited

U.S. PATENT DOCUMENTS

| | | | |
|---|---|---|---|
| 3,801,721 | 4/1974 | Bunger | 84/1.19 |
| 3,881,387 | 5/1975 | Kawakami | 84/1.24 |
| 3,930,429 | 1/1976 | Hill | 84/1.01 |
| 3,948,139 | 4/1976 | Melcher et al. | 84/1.19 |
| 3,981,218 | 9/1976 | Luce | 84/1.24 |
| 3,992,969 | 11/1976 | Robinson et al. | 84/1.01 |
| 3,999,458 | 12/1976 | Suzuki | 84/1.01 |
| 4,050,343 | 9/1977 | Moog | 84/1.01 |
| 4,106,383 | 8/1978 | Dittmar | 84/1.01 |
| 4,129,055 | 12/1978 | Whittington et al. | 84/1.01 |

OTHER PUBLICATIONS

Thomas E. Oberheim, "A Programmer for Voltage Controlled Synthesizers", Nov. 1, 1976, Preprint No. 1172, (E-3).

*Primary Examiner*—Stanley J. Witkowski

*Attorney, Agent, or Firm*—Allegretti, Newitt, Witcoff & McAndrews

[57] ABSTRACT

The disclosure describes an improved electronic musical synthesizer capable of storing, recalling, editing and restoring signals representing different timbres of sound. During the editing process, indicating circuitry enables a performer to determine whether the control knobs of the synthesizer have been adjusted to the same settings which resulted in the signals originally stored.

24 Claims, 12 Drawing Figures

V+
RECALL
162
53
VRB
131
132
133
+15 V
130
114
115
116
+15 V
160
113
PUP
165
D1 D2 D3 D4
P/S
TENS
LATCH
R
K
J
T/C
CL
Q0
Q4
164
UNITS
LATCH
RT1
RT2
RT3
RT4
TENS
BCD
RECALL
NUMBER
TO
MEMORY
RV1
RV2
RV3
RV4
UNITS
+15 V
+15
55
DECODER
167
DECODER
168
174
175
DISPLAY
TENS
170
DISPLAY
UNITS
172

SYNTHESIZER PRESET EDITING TECHNIQUES

This is a continuation of application Ser. No. 921,786, filed July 3, 1978, and now abandoned.

BACKGROUND AND SUMMARY OF THE INVENTION

This invention relates to electronic musical synthesizers and more particularly relates to improved circuitry for recalling, editing and restoring parameter signals representing different timbres of sound.

Electronic musical synthesizers are valued by musicians for their ability to create different qualities or timbres of sound. Whereas a piano or trumpet can create only a single characteristic timbre of sound and an organ can create at most a few dozen different timbres of sound, a typical synthesizer can create thousands of different timbres. In this specification and claims, timbre means the quality or characteristic of a sound. The quality or character may be controlled by various sound parameters, such as, for example, frequency, octave, waveshape or harmonic spectrum.

Electronic musical synthesizers have been reduced in size and cost dramatically over the past decade. As a result, they are being used in live performances to a greater extent than ever before. This use of synthesizers has created a need for improved means of conveniently and accurately altering the vast number of different sound timbres which a synthesizer can create.

In order to generate a specific sound on a typical synthesizer, the performer must carefully set the position of many control knobs. There may be 40 to 100 such control knobs that require individual manipulation in order to achieve the desired timbre of sound. During a live performance, the performer may want to change the timbre of the sound from one section of a composition to another. Typically, such a transition must be achieved in less than one second. The transition cannot be made if a large number of control knobs must be repositioned.

In order to overcome the foregoing limitation of synthesizers, there have been attempts to fabricate programming circuits capable of storing the positions of the control knobs and automatically recalling the stored information in order to produce a desired timbre of sound. One such programming circuit is described by Thomas E. Oberheim published in Preprint No. 1172 (E3) entitled "A Programmer for Voltage-Controlled Synthesizers" which was presented to the Audio Engineering Society at its 55th convention Oct. 29–Nov. 1, 1976. Although the Oberheim programming circuit provides a means of rapidly changing from one prestored timbre of sound to another, it does not provide any means of "editing" the stored information. In order to change the information stored by the Oberheim circuity, each of the synthesizer control knobs and settings must be properly positioned from "scratch". That is, each of the control knobs must be set or repositioned even if only one of the control knobs needs to be altered in order to edit the stored information to create the desired timbre. As a result, it requires a relatively long period of time in order to edit or modify a stored timbre of sound. This limitation has prevented synthesizers from realizing their full potential, especially as performing instruments.

Accordingly, it is one object of the present invention to develop an electronic musical synthesizer capable of conveniently editing a preset group of parameter signals representing a predetermined timbre of sound which has been stored in a memory.

Another object of the invention is to produce a synthesizer of the foregoing type in which an indicator informs a performer when a control knob of the synthesizer has been reset to the same position previously used to store a signal in the memory.

Still another object of the invention is to produce a synthesizer with an indicator of the foregoing type in which the indicator shows a performer when the setting of the control knob is above or below the value stored in memory.

Another object of the invention is to provide a multiple edit synthesizer in which all of the control knobs are simultaneously available to modify a stored sound timbre, so that the performer can change the knobs in any order and instantaneously hear the resulting changes in sound timbre.

Yet another object of the invention is to provide a synthesizer in which an edited timbre of sound can be directly compared with an originally-stored timbre of sound.

Still another object of the invention is to provide a synthesizer which can be controlled either from information stored in memory or from local control knobs.

Yet another object of the invention is to produce a synthesizer with an editing feature which enables certain parameter circuits of the synthesizer to be controlled from memory and other parameter circuits of the synthesizer to be simultaneously controlled from a control knob.

Still another object of the invention is to provide a synthesizer of the foregoing type in which an edited version of a previously stored group of parameter signals is temporarily held in an auxiliary memory, and the synthesizer can be controlled from the auxiliary memory.

Yet another object of the invention is to provide a single edit synthesizer in which a single indicator can be used to show a performer whether any one of a plurality of control knobs is in the position previously used to store information in memory.

Still another object of the invention is to provide a single edit synthesizer in which multiple control settings can be recalled and edited using a single digital-to-analog converter and a single analog-to-digital converter.

DESCRIPTION OF THE DRAWINGS

These and other objects and advantages of the present invention will hereafter appear for purposes of illustration, but not of limitation, in connection with the accompanying drawings, wherein like letters or numbers refer to like parts throughout, and wherein.

and

Figure 6:
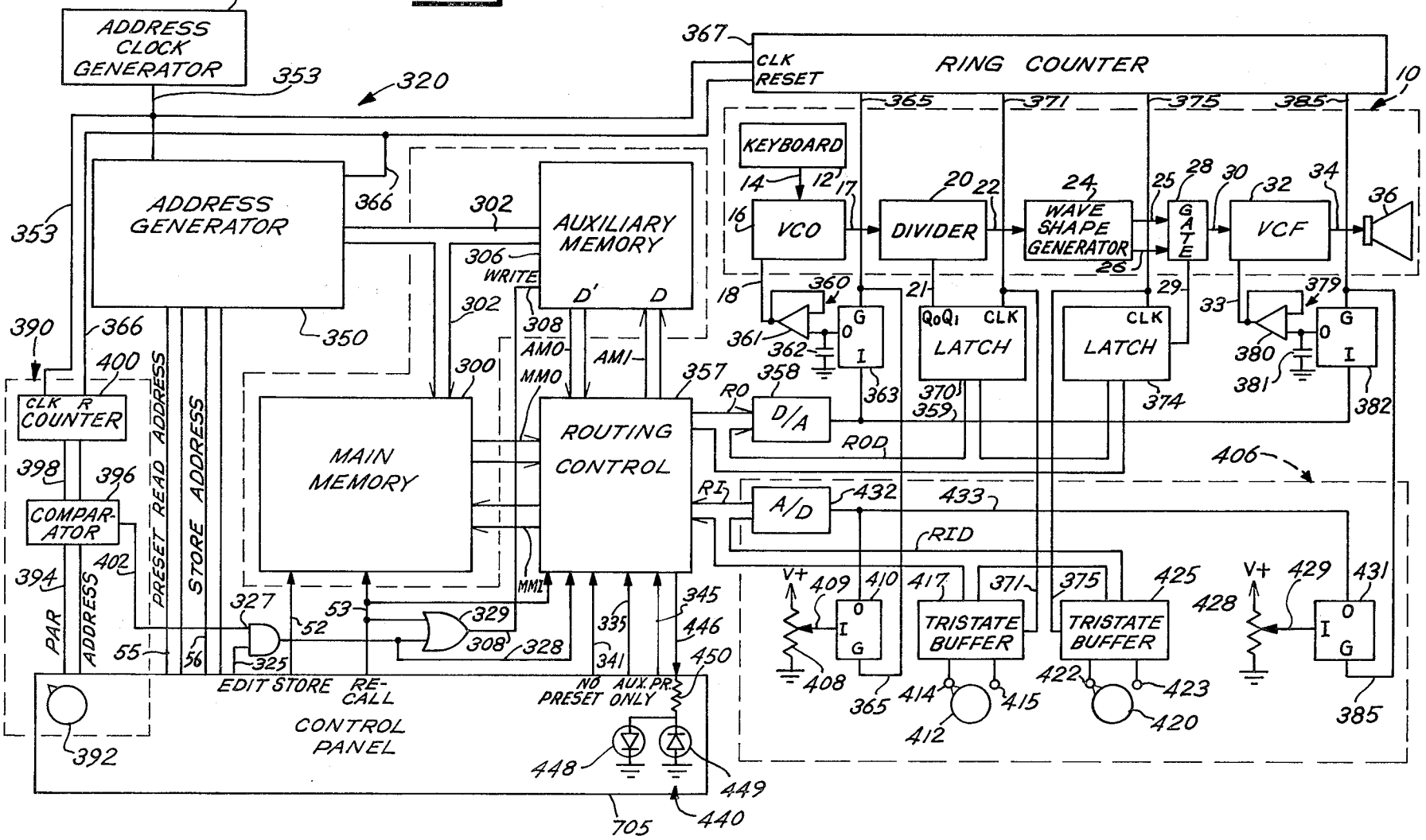
FIG. 6 is a block diagram of a preferred form of a single edit embodiment of the present invention shown in connection with an exemplary synthesizer.
Figure 10:
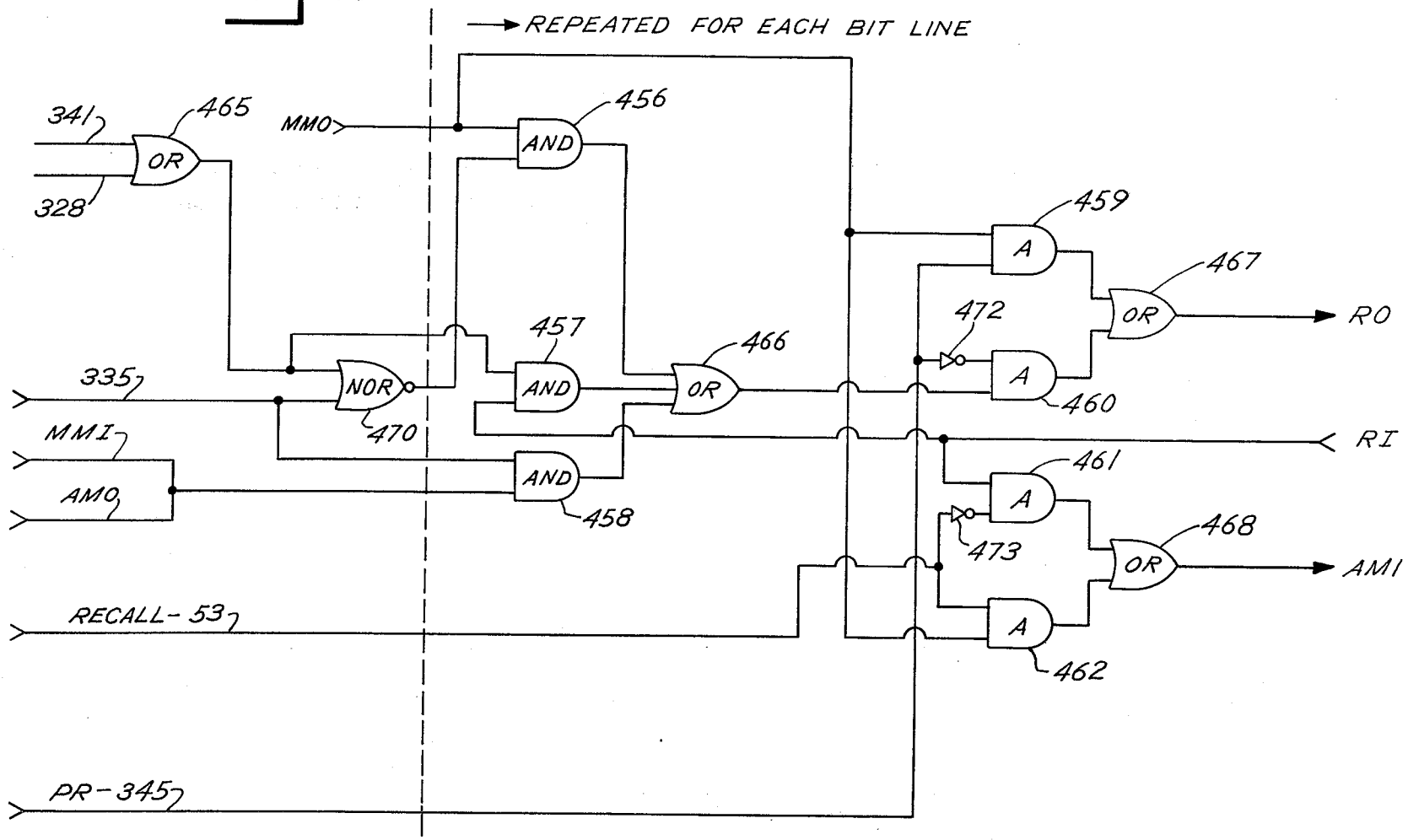

FIG. 10 is a logic circuit diagram of a preferred form of the routing control shown in FIG. 6.

DESCRIPTION OF THE PREFERRED EMBODIMENT

Figures 1A, 1C:
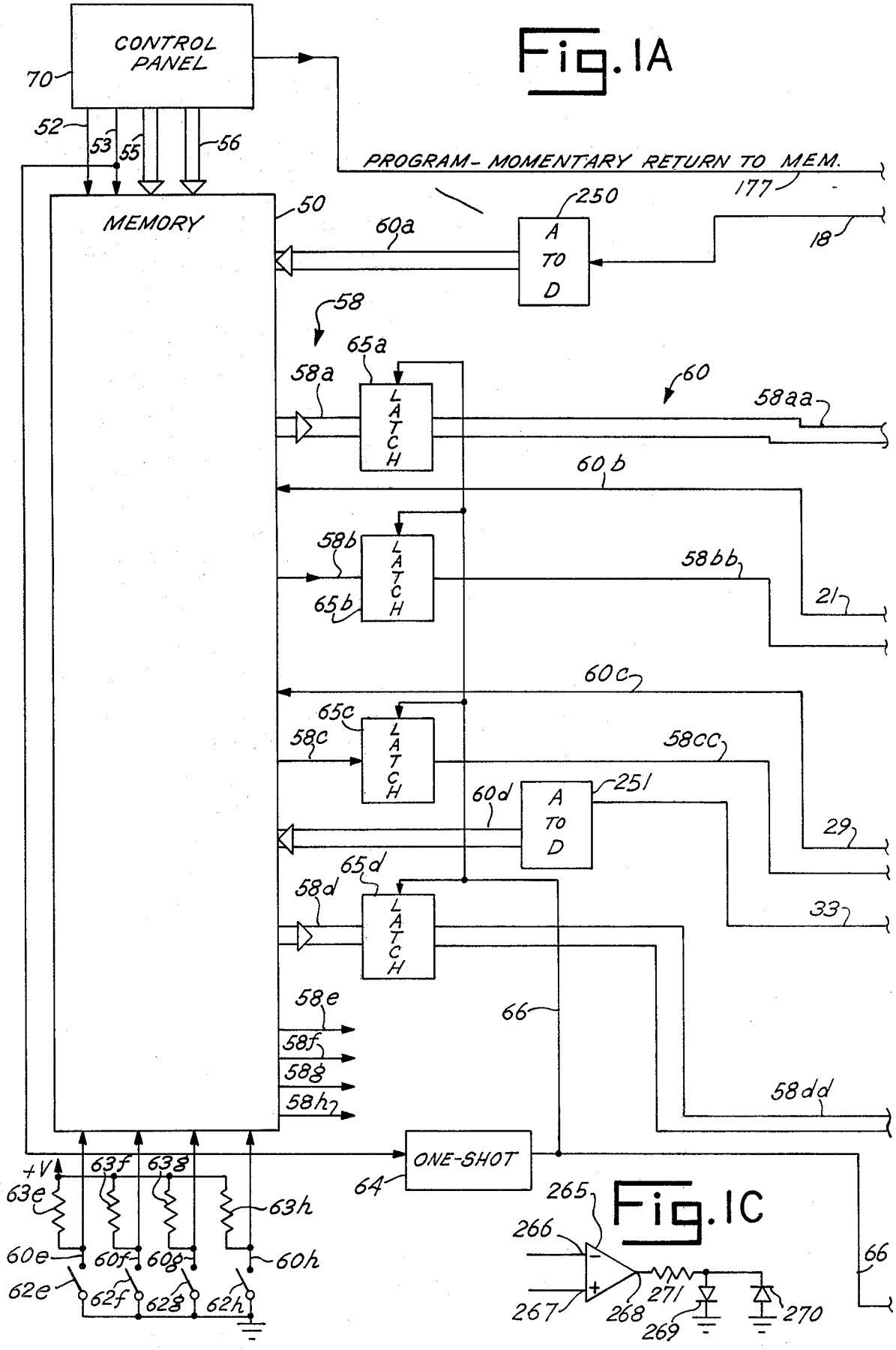
FIGS. 1A and 1B are schematic block diagrams of a preferred form of a multiple edit embodiment of the present invention shown in connection with an exemplary synthesizer.
FIG. 1C is an electrical schematic diagram of a preferred form of comparator shown in FIG. 1B.
Figure 1B:
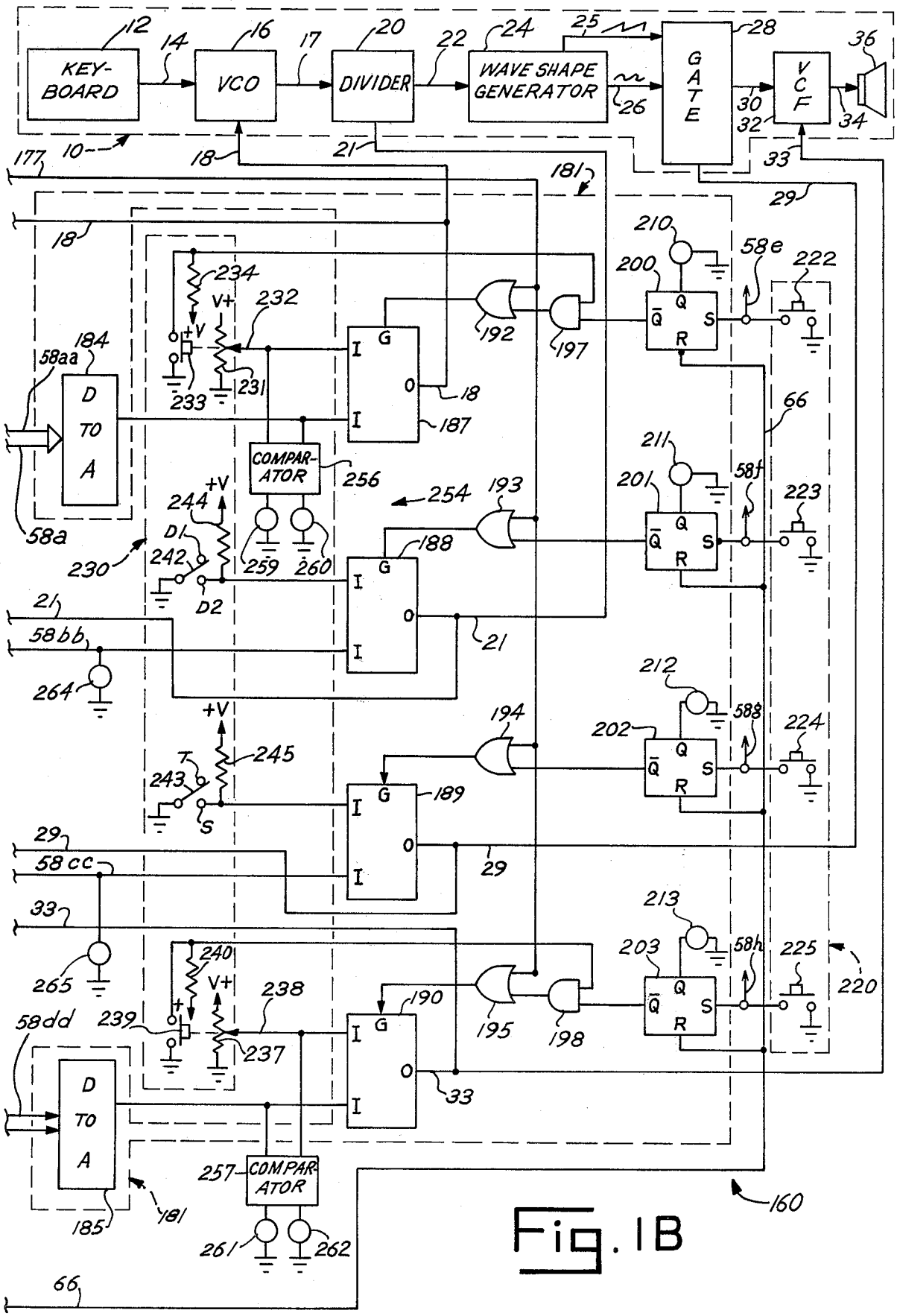

Referring to FIGS. 1A and 1B, the multiple edit embodiment of the present invention may be used in connection with any electronic musical synthesizer having parameter circuits capable of producing variable timbres of sound which are operated by either analog or digital control signals. One exemplary musical synthesizer 10 having four such parameter circuits is illustrated in FIG. 1B. The synthesizer includes a piano-type keyboard 12 which transmits signals indicating the key depressed over a keyboard bus 14 to a voltage-controlled oscillator (VCO) 16. The key depressed determines the pitch of the note desired to be sounded by a performer via VCO 16. In response to an analog voltage on conductor 18, VCO 16 alters the repetition rate of pulses produced on an output conductor 17. The pulses are divided to place the selected note in the proper octave by a programmable divider 20. In the present example, the pulses are divided by a factor of one or two depending on the logic state of a conductor 21. By changing the logic state of conductor 21 from a one to a zero value, programmable divider 20 is able to vary the octave of the synthesized tones.

The divided pulses produced on output conductor 22 are used as an input to a conventional waveshape generator 24. A sawtooth waveshape signal is generated on a conductor 25 and a sinusoidal signal is generated on a conductor 26. Both conductors 25 and 26 form inputs to a conventional analog gate 28. By varying the logic state on conductor 29, either the sawtooth or sinusoidal waveshapes are transmitted through the gate to an output conductor 30. As a result, the waveshape parameter can be controlled by the gate.

The selected waveshape signal on conductor 30 provides an input to a voltage-controlled filter (VCF) 32. By varying the analog voltage on a conductor 33, VCF 32 is able to vary the harmonic content or spectrum of the shaped input signals in order to create tone signals on a conductor 34 which correspond to the desired tone. The tone signals are transmitted to a conventional audio output system 36, including a transducer for creating soundwaves corresponding to the tone signals.

Circuits 16, 20, 24 and 32 are exemplary of parameter circuits capable of synthesizing different timbres of sound defined by a set of parameters. By varying the values of the parameters produced by the parameter circuits, sounds with different timbres can be produced. In some commercial synthesizers, more parameter circuits typically are included. However, circuits 16, 20, 24 and 32 are sufficient to teach a person of ordinary skill in the art how to use the present invention in such a commercial synthesizer.

MULTIPLE EDIT EMBODIMENT

Referring to FIGS. 1A–4, a preferred form of multiple edit circuitry suitable for use in connection with the exemplary parameter circuits basically comprises a digital random access memory 50, a control panel module 70, including a preset selection circuit 72, a store circuit 140 and an edit circuit 160, a parameter selection circuit 220, and an adjustment circuit 230.

Referring to FIG. 1A, memory 50 is designed to hold 64 different groups of parameter signals, each group representing a different timbre of sound and containing 26 bits of data arranged as follows in TABLE 1:

TABLE 1

| PARAMETER SIGNAL | VCO | DIVIDER | WAVESHAPE GATE | VCF | LOCAL CONTROL |
|---|---|---|---|---|---|
| BITS OF SIGNAL | 1–10 | 11 | 12 | 22<br>13–22 | 23–26 |

In TABLE 1, the terms in the upper line represent the parameter signals which form each group stored in memory and the numbers in the lower line represent the bits forming each of the parameter signals. In this specification and claims "signal" is used in the broad sense of any detectable physical quality or impulse, such as voltage, current, magnetic field strength, light intensity or light polarity. The relationship between the parameter signals and the parameter controlled by each of the signals is shown in TABLE 2:

TABLE 2

| Parameter Signal | | Parameter Controlled |
|---|---|---|
| VCO | — | frequency |
| DIVIDER | — | octave shift |
| WAVESHAPE GATE | — | waveshape |
| VCF | — | harmonic spectrum |

Of course, more bits can be added to each signal group or word stored in memory if additional parameter circuits are utilized. In addition, more groups can be stored to define additional timbres of sound if the memory is expanded.

Still referring to FIG. 1A, memory 50 includes a write input 52 and a read input 53 which work in cooperation with a recall address bus 55 and a store address bus 56. Memory 50 also includes a data output bus 58 which is subdivided into buses **58*a*–58*h*. Bus 58*a* is a ten conductor output bus which transmits the VCO parameter signal; bus 58*b* is a one conductor output bus which transmits the divider parameter signal; bus 58*c* is a one-conductor bus which transmits the waveshape gate parameter signal; bus 58*d* is a ten conductor output bus which transmits the VCF parameter signal; and buses 58*e*–58*h* are each one-conductor buses which transmit signals determining which of the parameter circuits will be under local control, rather than control from memory 50**. The signals can be transmitted by conventional open collector ORing circuitry, not shown.

Memory 50 also includes a data input bus 60 which is subdivided into buses **60*a*–60*h*. Bus 60*a* is a ten-bit bus which transmits a VCO parameter signal; bus 60*b* is a one-conductor bus which transmits a divider parameter signal; bus 60c is a one-conductor bus which transmits a waveshape gate parameter signal; bus 60d is a ten-conductor bus which transmits a VCF parameter signal; and buses 60e–60h each are one-conductor buses which determine the information read out on buses 58e–58h. Buses 60e–60h are controlled by switches 62e–62h and resistors 63e–63h. A one-shot multivibrator 64 generates a latch pulse which controls latches 65a–65d. When the latches receive a pulse from one-shot 64 over a conductor 66, they latch the output data received on output buses 58a–58d. The data then is retained for transmission over output buses 58aa, 58bb, 58cc and 58dd. The one-shot, in turn, produces the latch pulse in response to a read pulse generated on conductor 53**.

Figure 2:
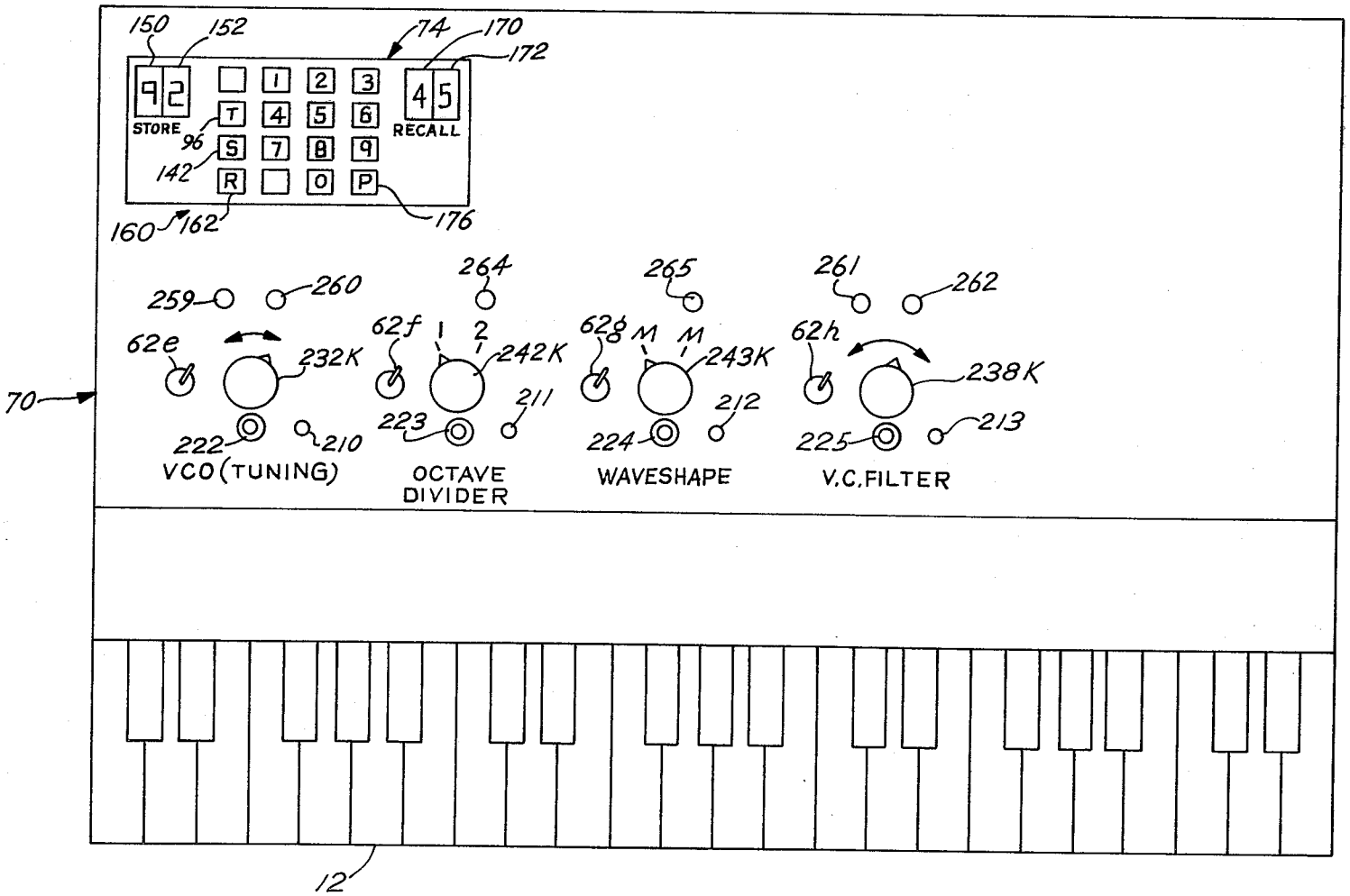
FIG. 2 is a front elevational view of a preferred form of control panel for the apparatus shown in FIGS. 1A and 1B.
Figure 3:
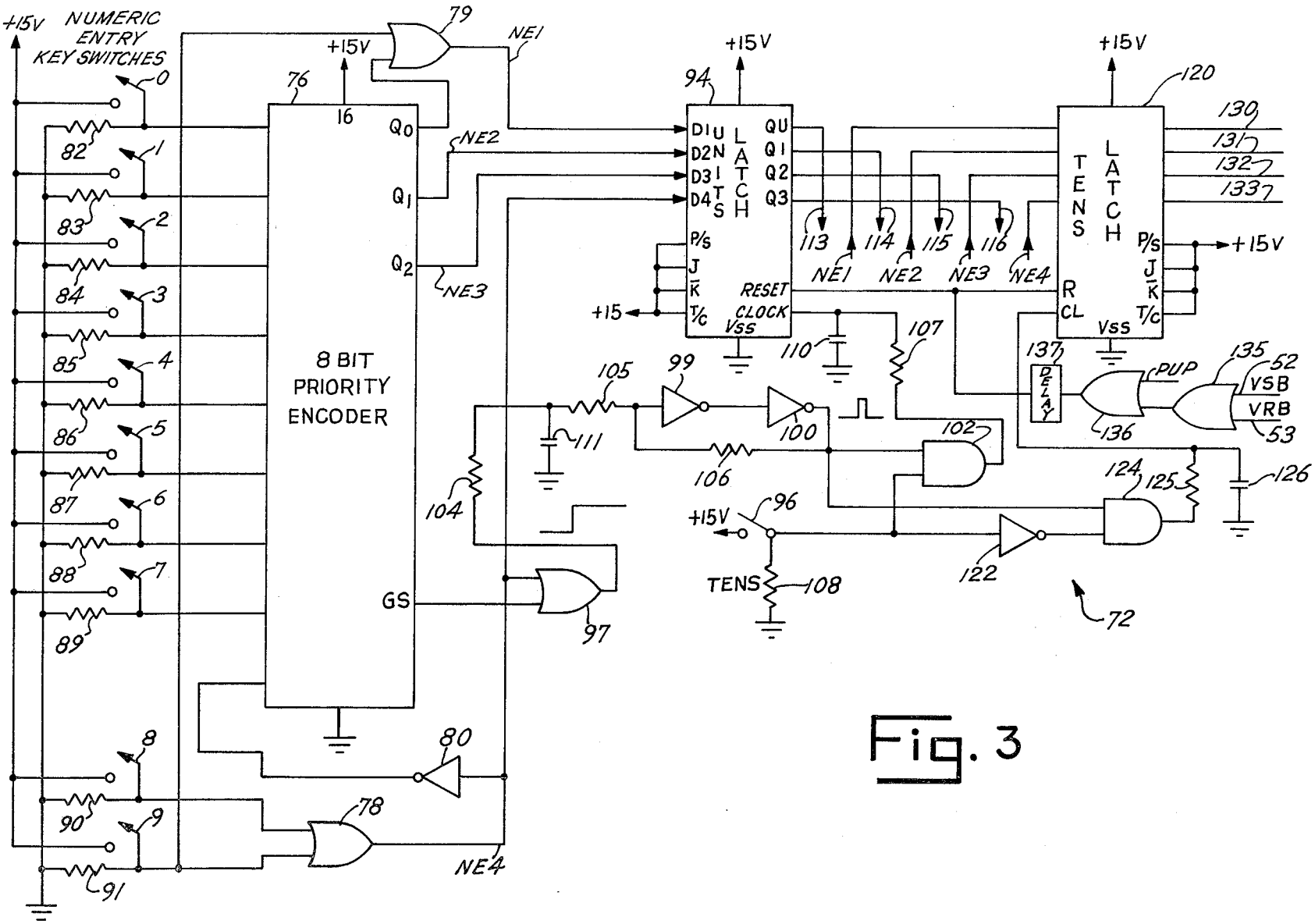
FIG. 3 is an electrical schematic diagram of a preferred form of preset selection circuit included within the control panel.

Referring to FIGS. 2 and 3, preset selection circuit 72 comprises keyboard switches 0–9 of a data entry keyboard 74 located in the control panel. The key switches operate a type 4532, 8-bit priority encoder 76. The encoder receives input from each of switches 0–9 and converts the input to a corresponding 4-bit code which is transmitted over outputs NE1–NE4 in binary coded decimal (BCD) form. Additional circuitry enabling the encoding of key switches 0–9 includes OR gates 78, 79, an inverter 80 and resistors 82–91 connected as shown.

Since 64 groups of parameter signals can be stored in memory 50, selection of the groups involves the selection of a units digit as well as a tens digit. The units digit entered on the keyboard is stored in a type 4076 latch 94. Storage in the latch is further enabled by a clock circuit comprising: a "tens" switch 96; an OR gate 97; inverters 99, 100; an AND gate 102; resistors 104–108; and capacitors 110, 111. The GS output of encoder 76 creates a pulse each time one of keys 0–9 is closed. The units value stored in latch 94 is transmitted in the BCD form over output conductors 113–116.

The tens value associated with the group of parameter signals selected by a performer is stored in a type 4076 latch 120. Storage of the tens value is enabled by a clock circuit comprising: an inverter 122; an AND gate 124; a resistor 125; and a capacitor 126. The tens value stored in latch 120 is transmitted over conductors 130–133 in BCD form.

Latches 94 and 120 are reset to 0 values by a reset circuit comprising OR gates 135, 136 and a delay circuit 137.

Figure 4:
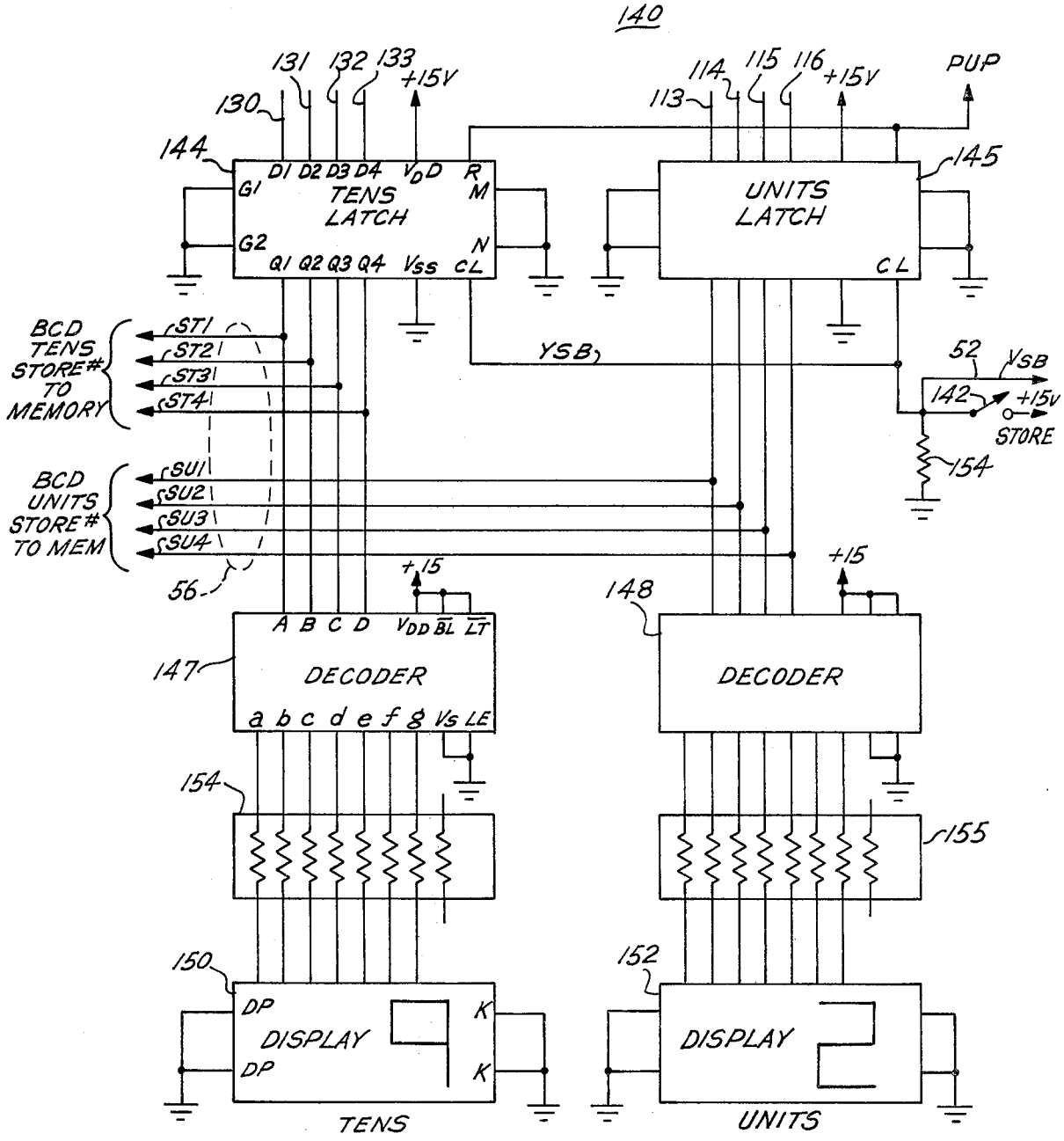
FIG. 4 is an electrical schematic diagram of a preferred form of store circuit included within the control panel.

Referring to FIGS. 2 and 4, store circuit 140 comprises a store key switch 142 which is included in keyboard 74. The circuit also includes a tens latch 144 and a units latch 145, as well as BCD to 7-segment decoders 147, 148. The decoders operate a tens 7-segment display 150 and a units 7-segment display 152 through resistor arrays 154, 155.

In order to store a preset group of parameter signals in a memory location, such as location 92, the latches of the preset selection circuit 72 and store circuit 140 must be cleared of any obsolete data. This is accomplished by generating a power-up pulse (PUP) which clears latches 94, 120, 144 and 145. After the latches have been cleared, and in order to address location 92, the performer depresses the tens switch 96 and the nine switch on keyboard 74. In response to this switching, the BCD code for nine is stored in latch 120. The performer then releases ten switch 96 and depresses the two switch on keyboard 74. As a result of this switching, the BCD form of the number two is encoded by encoder 76 and stored in latch 94. The performer then depresses the store switch 142, and the information stored in latches 94 and 120 is transmitted to latches 145 and 144, respectively.

Latches 144 and 145 provide the BCD address for memory location 92 over store address bus 56. At the same time, decoders 147 and 148 decode the digits 9 and 2, respectively, in order to provide a proper display on display units 150 and 152. As a result of this operation, the performer knows that the information on data input bus 60 will be stored in memory location 92.

As soon as store switch 142 is depressed, a logical one store signal is generated on conductor 52 and is transmitted through OR gates 135, 136 and delay circuit 137 in order to reset latches 94 and 120. However, the display circuits 150 and 152 will continue to display the digits 92 until new digits are entered from keyboard 74.

Figure 5:
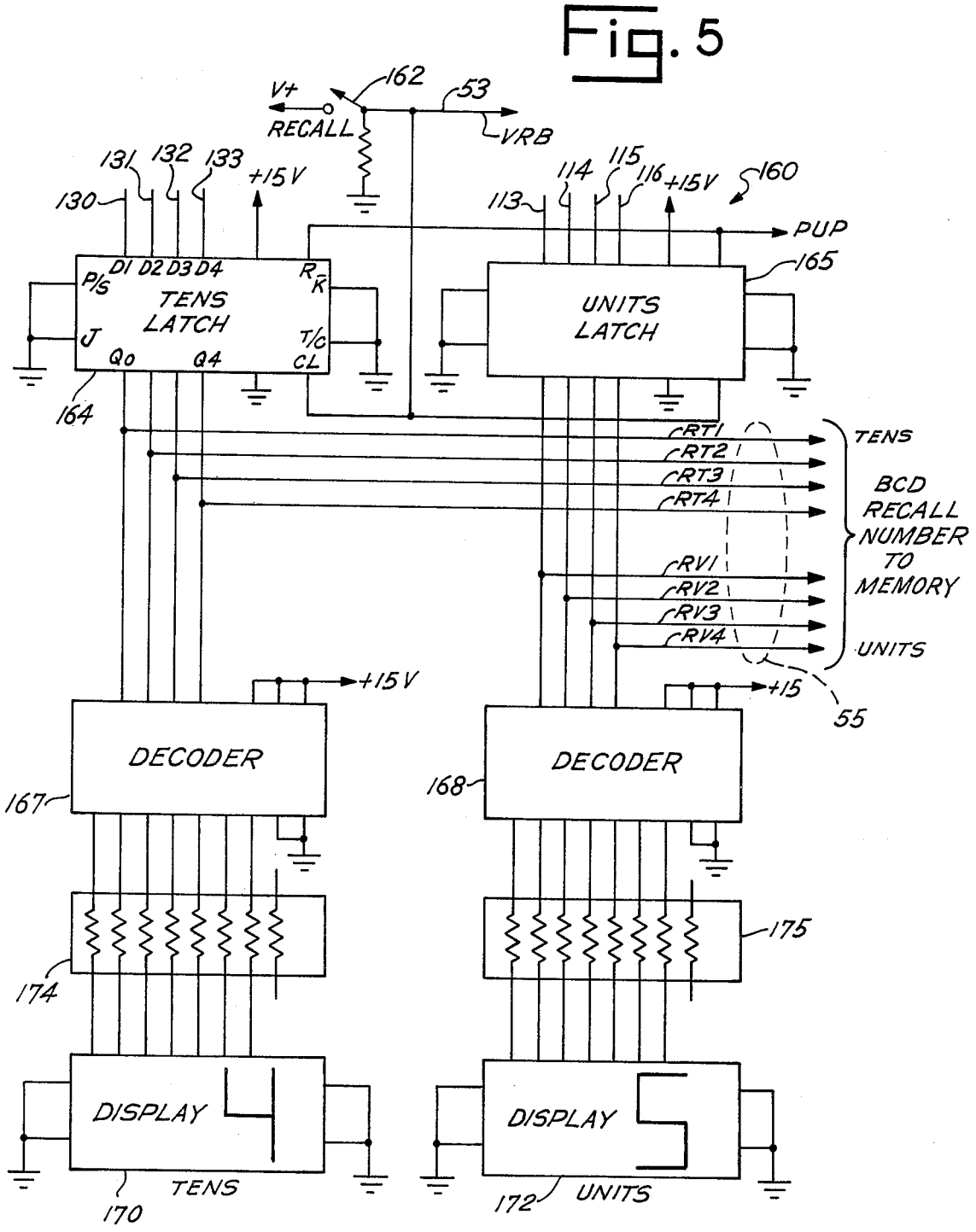
FIG. 5 is an electrical schematic diagram of a preferred form of a portion of an edit circuit shown in FIGS. 1A and 1B.

Referring to FIGS. 2 and 5, edit circuit 160 comprises a recall key switch 162, a tens latch 164 and a units latch 165. Inputs to latches 164 and 165 are from latches 120 and 94, respectively (FIG. 3). The edit circuit also includes BCD to 7-segment decoders 167, 168 which control a tens 7-segment display 170 and a units 7-segment display 172 through resistor arrays 174, 175. The edit circuit also includes a program switch 176 (keyboard 74, FIG. 2) which generates a logical one signal on conductor 177 (FIG. 1A) when the key is depressed.

The portion of the edit circuit shown in FIG. 5 operates in a similar manner to the store circuit. In order to recall a preset group of parameter signals stored in memory, the address of the signals is entered on the keyboard 74. For example, if the desired preset group of parameter signals is located at address 45, the performer enters the digits 45 on the keyboard in the same manner previously described. He then depresses recall switch 162 so that the BCD form of the digit 4 is entered in latch 164 and the BCD form of the digit 5 is entered in latch 165. The BCD outputs from latches 164 and 165 then operate through read address bus 55 to address the proper location in memory 50. At the same time, decoders 167 and 168 decode the address memory location in order to display the digits 45 on display units 170, 172.

When recall switch 162 is depressed, a logical one signal is generated on conductor 53 which is transmitted through OR gates 135, 136 and delay line 137 in order to reset latches 94 and 120 (FIG. 3). However, display units 170, 172 continue to display the digits 45 until new digits are entered from keyboard 74.

Referring to FIG. 1B, edit circuit 160 also comprises edit gates 181 which include digital-to-analog converters 184, 185 and analog gates 187–190. Each of the analog gates includes a data input I, an output O and a gate G. When gate G is switched to a logical one state, one of the inputs is transmitted to the output; when the gate is switched to a logical zero state, the other input is transmitted to the output. Gates 181 also include OR gates 192–195, AND gates 197, 198, and flip-flops 200–203. Edit lights 210–213 are operated by the Q output of flip-flops 200–203 and indicate the time during which a corresponding parameter circuit is being operated from a local control rather than from memory.

Still referring to FIG. 1B, parameter selection circuit 220 comprises momentary switches 222–225 which select the various parameter circuits for local control rather than control by the memory. The momentary switches set the flip-flops in group 200–203, thereby enabling one or more analog gates to communicate data from a local control switch or potentiometer rather than from memory.

Referring to FIG. 1B, adjustment circuit 230 comprises a potentiometer 231 having a slider 232 which moves cooperatively with a momentary switch 233. A bias resistor 234 biases the momentary switch.

The adjustment circuit also includes another potentiometer 237 having a slider 238 which cooperatively moves with a momentary switch 239. The momentary swtch is biased by a resistor 240.

Referring to FIG. 2, slider 232 is connected to a knob 232K which can be rotated in order to move the slider with respect to potentiometer 231. Switch 233 is normally open, but can be closed by pressing knob 232K toward the control panel. By depressing the knob toward the control panel and simultaneously rotating it, switch 233 can be closed at the same time slider 232 is moved with respect to potentiometer 231. This is an important feature which enables the performer to achieve local control of a parameter circuit and to adjust the parameter circuit at the same time he is using his other hand to perform on the keyboard. Slider 238 and switch 239 are operated in an analogous manner to slider 232 and switch 233, respectively, from a knob 238K.

Referring again to FIG. 1B, adjustment circuit 230 also includes digital switches 242 and 243. The switches are connected to control knobs 242K and 243K, respectively, which select the proper octave and select the waveshape (FIG. 2). Switch 242 operates between terminals D1, D2 and switch 243 operates between terminals T and S. The switches are biased by resistors 244 and 245.

Referring to FIG. 1A, the adjustment circuit also includes analog-to-digital converters 250, 251. Adjustment circuit 230 is used to generate adjusted parameter signals suitable for replacing the parameter signals stored in memory. Referring to FIGS. 1B and 2, an adjustment indicator circuit 254 comprises comparators 256, 257 and light bulbs or light-emitting diode pairs 259, 260 and 261, 262. An exemplary adjustment indicator circuit is shown in more detail in FIG. 1C and comprises an operational amplifier 265, including an inverting input 266, a non-inverting input 267 and an output 268. Light-emitting diodes 269, 270 are connected in a reverse polarity configuration and receive output current through a resistor 271. Diode pair 259, 260 indicates the relative values of the VCO signals generated from memory and potentiometer 231, and diode pair 261, 262 indicates the relative values of the VCF signals generated from memory and potentiometer 237.

Referring to FIGS. 1B and 2, the adjustment indicator circuit also includes bulbs or light-emitting diodes 264 and 265 which indicate the state of the octave divider and waveshape parameter signals received from memory. For example, if the octave divider parameter signal indicates that the oscillator pulses should be divided by 2, bulb 264 is lighted, whereas an indication that the pulses should be divided by 1 causes the bulb to be unlighted. Similarly, if the waveshape parameter signal indicates that a sine wave is selected from memory, light 265 is lighted, whereas an indication that the sawtooth waveform is selected causes bulb 265 to be unlighted. Thus, by comparing the position of local control knobs 242K and 243K with the lighted states of bulbs 264 and 265, the performer can compare the local control setting with the parameter signals obtained from memory.

In order to illustrate the operation of the circuitry, it will be assumed that the performer desires to recall the preset parameter signal stored at memory location 45, to edit the parameter signals and then to store the edited version of the signals in storage location 92. In order to achieve this result, the performer enters the digits 45 on keyboard 74 and depresses recall switch 162 in the manner previously described. The digits 45 then will appear in the recall display units 170, 172 located on the control panel (FIG. 2).

In response to this operation, the preset parameter signals for memory location 45 are read out of the memory on output data bus 58. The VCO and VCF parameter signals are converted to analog form by digital-to-analog converters 184, 185. Assuming local control bits 23–26 in memory location 45 are in their one states so that output busses **58*e*–58*h* are in their one states, the parameter circuits will be controlled from the memory. As a result, the converted analog parameter signals for VCO and VCF, as well as the digital divider and waveshape gate signals transmitted over conductors 58*b* and 58*c*, each are transmitted through analog gates 187–190 (FIG. 1B) to the respective parameter circuits. In this form of operation, each of the parameter circuits is controlled from the parameter signals stored in memory 50 in order to produce a preset timbre of sound. The sound is heard as soon as a key of playing keyboard 12** is depressed.

In order to edit the preset timbre of sound, the performer may close any one of switches 222–225 (FIGS. 1B and 2) in order to provide local control for one or more of the parameter circuits. For example, if the performer decides to change the frequency of pulses produced by VCO 16, he closes switch 222, thereby transferring control of the analog voltage on conductor 18 to a potentiometer 231. By rotating knob 232K (FIG. 2) the performer can alter the frequency produced by VCO 16, while the remainder of the parameter circuits continue to be controlled from memory 50. After the VCO has been locally adjusted by knob 232K, the performer may wish to also adjust the programmable divider parameter circuit. In order to accomplish this result, he closes switch 223 and then manipulates a knob 242K until the desired sound is achieved. By closing one or more of switches 222–225, the analog gates transfer the signals from adjustment circuit 230, rather than from memory 50. As a result, local control over any one or all of the parameter circuits can be achieved. This is an important feature of the multiple edit embodiment which enables the performer simultaneously to edit multiple parameters with a degree of convenience and rapidity previously unattainable.

In addition to adjusting or editing the parameter circuits, the performer also may set one or more of switches **62*e*–62*h* (FIG. 1A) in order to preprogram one or more parameter circuits for local control. For example, if the performer decides that he wants to maintain local control over the preset VCO parameter signal stored at memory location 92, he would close switch 62*e* prior to depressing the store switch 142. In response to the closure of switch 62*e*, bit 23 in the memory location would be switched to a zero state which would result in a zero logic signal being transmitted on conductor 58*e* when the signals at location 92 are recalled. This zero logical signal would set flip-flop 200, thereby controlling VCO 16 from knob 232K**.

During the editing process, adjustment indicator circuit 254 provides invaluable help to the performer. Normally, if a performer attempts to edit a stored parameter signal, he cannot determine the relationship between the value of the recalled signal from memory and the setting of the corresponding local control knob. This is an undesirable situation because the performer often likes to set his control panel knob to a setting which produces a local signal having the same value as the signal recalled from memory. After the same signal value is achieved by local control, only a slight change in the knob setting may be required in order to edit the sound in the desired manner. Without an adequate indicator circuit, this result is not possible to achieve. However, by using indicator apparatus 254, the performer can quickly and easily adjust his control panel knob to produce the same local signal value as the recalled parameter signal. In this manner, the performer can start where the memory left off (rather than starting from "scratch") in his attempt to achieve the desired sound.

In order to achieve this result, a comparator circuit is provided for each of the VCO and VCF parameter circuits. For example, comparator 256 compares the VCO control signal generated by potentiometer 231 with the VCO control signal received from memory and converted to analog form by digital-to-analog converter 184. If the local signal from potentiometer 231 is greater than the memory signal from converter 184, the "high" bulb 259 is lighted and the "low" bulb 260 is unlighted. If the value of the local signal is less than the value of the signal from memory, bulb 260 is lighted and bulb 259 is unlighted. When the local and memory values are identical, both bulbs 259 and 260 are unlighted so that the operator knows his control knob 232K will produce the same signal value as the corresponding memory signal. The operator can then proceed to increase or decrease the value by local control to the desired setting. Experience has shown that the foregoing indicator is an invaluable aid to editing synthesizer signals. A similar comparator 257 is used in connection with VCF 32.

Since program divider 20 and waveshape analog gate 28 select only two signals, there is no need for a comparator in connection with these circuits. As a result, a single light bulb can be used for each of these circuits. The lighted state of the bulb is visually compared with the local control knob setting in order to determine whether the local control has generated the same signal value stored in memory. For example, if the performer decides to change the setting of the program divider, he can observe the lighted state of bulb 264. If the bulb is lighted, he knows that the memory has programmed the divider to divide by two. By observing the position of the control knob 242K, he can quickly determine whether the local signal is the same as or different from the divide by two signal stored in memory. A similar arrangement is used in connection with waveshape control knob 243K.

As previously described, light bulbs 210–213 indicate whether any of switches 222–225 are closed (FIGS. 1B and 2). For example, if the performer decide to edit the VCO setting, he closes switch 222 which causes light bulb 210 to light. Thus, by observing bulbs 210–213 a performer can quickly tell which of the control knobs on the control panel are effective for local control.

After the performer has edited the signals recalled from memory, he may want to compare the edited sound timbre with the original stored sound timbre. To achieve this result, the performer depresses momentary program switch 176 on the entry keyboard. Switch 176 causes conductor 177 to be raised to a logical one state, thereby causing analog gates 187–190 to transmit the signals received from memory to the parameter circuits. As a result, the sound timbre originally stored in memory is heard by the performer as soon as he depresses a key on playing keyboard 12. When switch 176 is released, the edited sound again is heard. Thus, a direct comparison between the edited and originally-stored sound timbres is easily achieved.

As soon as the performer has completed his editing of the signals recalled from memory and closed the desired number of switches **62*e*–62*h*, he can store the edited group of parameter signals by simply depressing store switch 142 (FIG. 2). At this time, each of the parameter signals appearing on data input buses 60 is stored in memory location 92** and may be recalled at any time by utilizing the recall key switch and keyboard in the manner previously described.

SINGLE EDIT EMBODIMENT

Referring to FIG. 6, a single edit embodiment of the present invention may be used in connection with a synthesizer 10 of the same type previously described in connection with FIG. 1B.

The single edit embodiment also includes a main memory 300 capable of storing 256 digital words, each word being sixteen bits in length. Such a memory is capable of storing 64 different groups of parameter signals in which there are four parameter signals per group. Each parameter signal is defined by a sixteen-bit word having the format shown in TABLE 3:

TABLE 3

| ANALOG | DIGITAL | UNUSED |
|---|---|---|
| 1–10 | 11–14 | 15–16 |

As shown in TABLE 3, the bits defining the proper value of an analog control signal are stored in bits 1–10. Likewise, if the parameter circuit requires digital control, the value of the digital control signal is stored in bits 11–14. Bits 15 and 16 of each word stored in memory are unused. However, they could be used in order to provide parity checking. Each sixteen-bit word controls a single parameter circuit. Since there are four parameter circuits in exemplary synthesizer 10, four words are stored to form a group of parameter signals which define a particular timbre of sound. These four words are stored in consecutive memory locations.

Referring to FIG. 6, main memory 300 also includes an address bus 302 which identifies a memory location from which a word can be read or in which a word can be stored. The reading and writing of words is enabled, respectively, by a read input conductor 53 and a write input conductor 52 of the same type used in connection with memory 50 (FIG. 1A). Memory 300 also includes a 16-bit data output bus MMO and a 16-bit data input buss MMI.

An auxiliary memory 306 is able to store four 16-bit words. This arrangement enables the memory to hold one group of parameter signals (defining one timbre of sound) in which each parameter signal consists of 16-bits. Data is written into the auxiliary memory by means of address bus 302 and a write input conductor 308. Since memory 306 stores only four words, only the least significant two bits of bus 302 are used. A 16-bit data output bus AMO and a 16-bit data input bus AMI provide access to and from the memory locations. Memory 306 is arranged to continuously read out the data stored in the memory locations on output bus AMO. As a result, a read enabling input conductor is not necessary.

Figure 7:
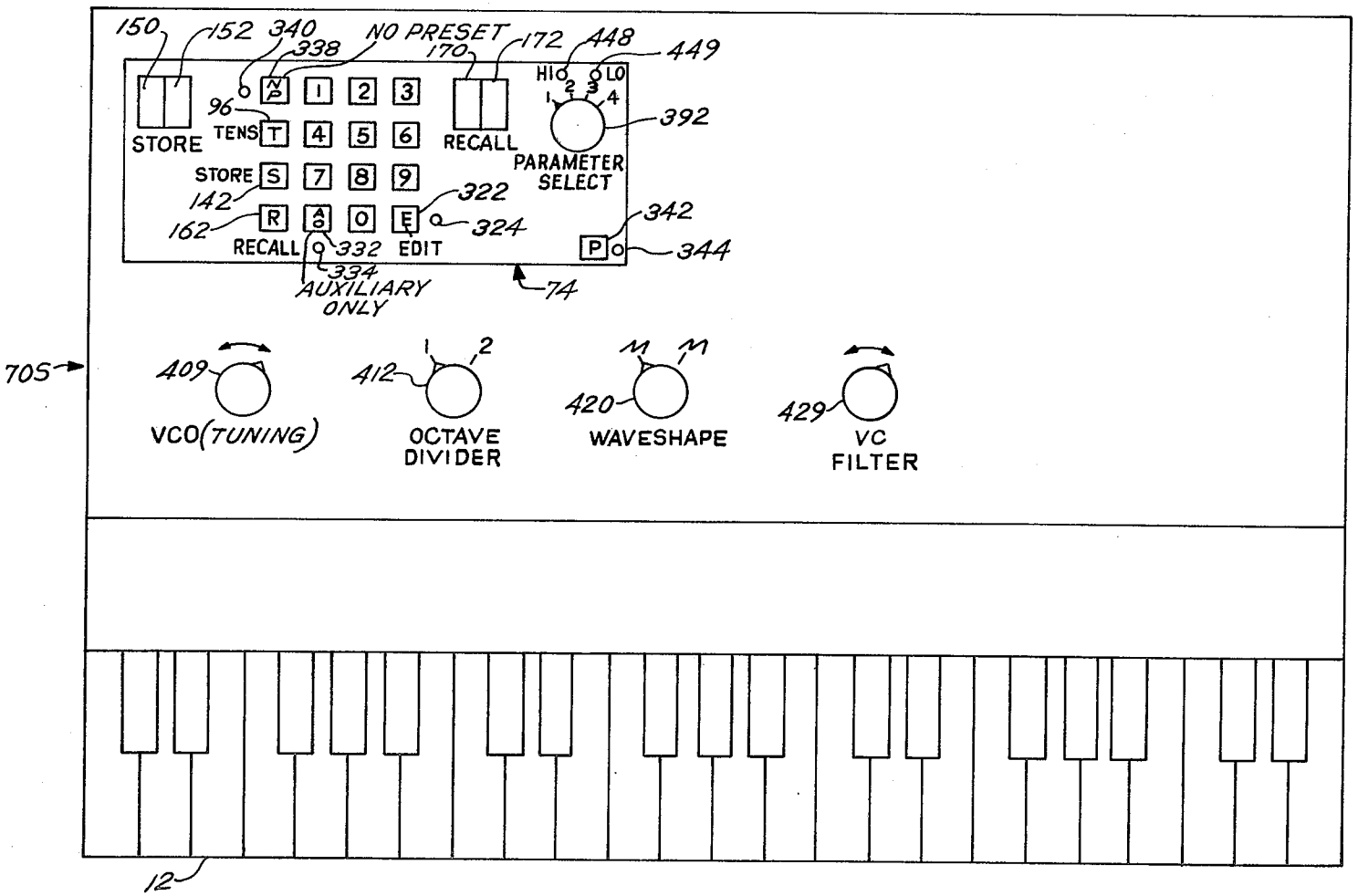
FIG. 7 is a front elevational view of a preferred form of the control panel shown in FIG. 6.

Referring to FIGS. 6 and 7, the single edit embodiment includes a control panel module 705 having a preset selection circuit 72 which is identical to the like circuit shown in FIG. 3, including a tens key switch 96. The control panel module also has a store circuit 140 which is identical to the like circuit shown in FIG. 4, including a store key switch 142, a store address bus 56 and displays 150, 152.

The single edit embodiment further has an edit circuit 320 which comprises the portion of edit circuit 160 shown in FIG. 5, including a recall key switch 162, a preset read address bus 55 and displays 170, 172.

Figure 8:
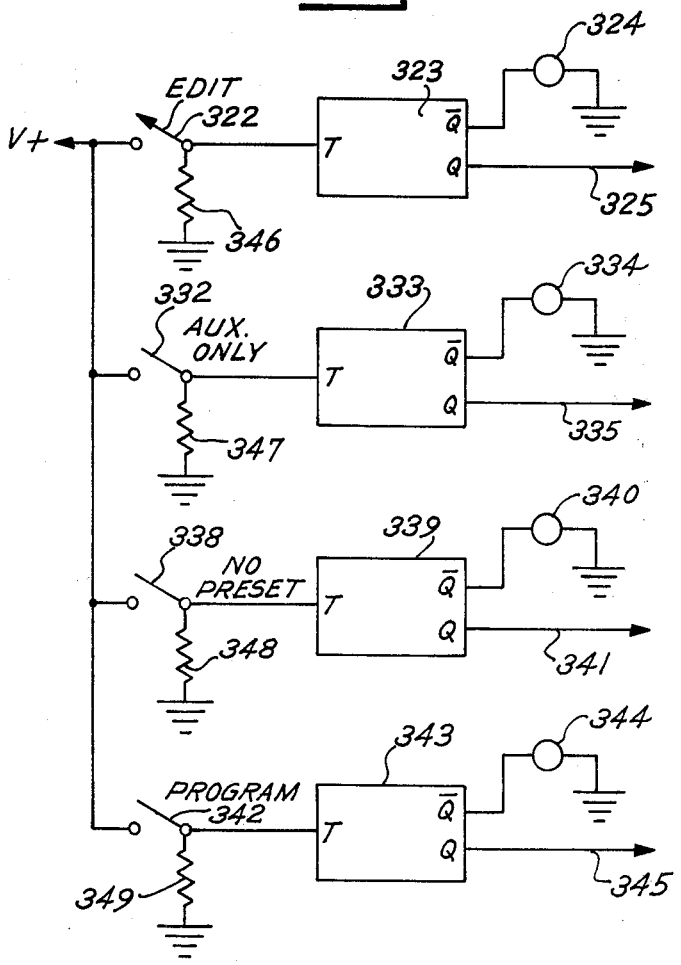
FIG. 8 is an electrical schematic diagram of a portion of the control panel circuitry shown in FIG. 6.

Referring to FIGS. 7 and 8, edit circuit 320 also includes an edit switch 322 which triggers a flip-flop 323 in order to control a light source and driver 324, as well as an output conductor 325. As shown in FIG. 6, output conductor 325 operates an AND gate 327 which generates an output over conductor 328 and which serves as an input to an OR gate 329.

Edit circuit 320 also includes an auxiliary only switch 332 (FIG. 8) which triggers a flip-flop 333 used to control a light source and driver 334 and to generate an auxiliary signal which defines the logic state of an output conductor 335.

Still referring to FIG. 8, the edit circuit also includes a no preset switch 338 which triggers a flip-flop 339 in order to control a light source and driver 340, as well as the logic state of an output conductor 341.

The edit circuit also includes a program switch 342 which triggers a flip-flop 343 in order to control a light source and driver 344, as well as the logic state of an output conductor 345.

The previously described edit switch 322, auxiliary only switch 332, no preset switch 338 and program switch 342 are included in keyboard 74 (FIG. 7). Each of switches 322, 332, 338 and 342 is biased by an appropriate resistor 346, 347, 348 and 349, respectively.

Referring to FIG. 6, edit circuit 320 also includes an address generator 350 which generates logic signals defining desired memory locations within memory 300, as well as auxiliary memory 306. An address clock generator 352 transmits clock pulses over a conductor 353. Address clock generator 352 indexes a starting address provided by address generator 350. Since the synthesizer includes four parameter circuits, and each 16-bit word in memory controls one parameter, four words are needed in order to form a group of parameter control signals capable of generating a desired timbre of sound. As soon as address generator 350 generates the starting address of the first of the four words in a selected group, address clock generator 352 generates clock pulses which index a counter within address generator 350 in order to address the remaining three words in the group. As will be explained in more detail later, the starting address produced by generator 350 is received over address bus 55 or 56.

Still referring to FIG. 6, the single edit embodiment includes a routing control 357 which routes data to, inter alia, a 14 conductor output data bus RO and a 14 conductor input data bus RI. The 10 bits of analog parameter data received on bits 1–10 of bus RO from bits 1–10 of a word stored in memory are converted to an analog voltage on an output conductor 359 by means of a digital-to-analog converter 358. Bits 11–14 of each word stored in memory are routed through bus RO to a 4 conductor digital output data bus ROD.

Since the parameter signals for controlling the parameter circuits of synthesizer 10 are circulated by a time division multiplex process, circuits are required in order to sample and hold or to latch the data on the output buses. Accordingly, edit circuit 320 also includes a sample and hold circuit 360 for operating VCO 16. The sample and hold circuit includes a buffer amplifier 361, a storage capacitor 362, and an analog gate 363 which is controlled by tap 365 of a ring counter 367.

Divider 20 is operated by a digital latch 370 which is controlled by a tap 371 of ring counter 367.

Waveshape selector gate 28 is operated by a digital latch at 374 which is controlled by a tap 375 of ring counter 367.

VCF 32 is operated by a sample and hold circuit 379 comprising an operational amplifier 380, a storage capacitor 381 and an analog gate 382 which is controlled by a tap 385 of ring counter 367. As the parameter signals for a particular parameter circuit are transmitted on the data output buses RO and ROD, the ring counter enables the appropriate sample and hold circuit or latch so that the data can be stored and used to control the proper parameter circuit.

Still referring to FIG. 6, the single edit embodiment also includes a parameter selection circuit 390 having a parameter selection knob 392 located on control panel 70S (FIG. 7). As shown in FIG. 7, knob 392 has four positions which can select any one of the four parameter circuits for local control as shown in TABLE 4.

TABLE 4

| Knob Position | Corresponding Parameter Circuit |
|---|---|
| 1 | VCO 16 |
| 2 | DIVIDER 20 |
| 3 | WAVESHAPE GATE 28 |
| 4 | VCF 32 |

The position of the knob 392 controls the logic states of a two-bit parameter address bus 394 which serves as an input to a comparator 396. The other input to the comparator is received by a two-bit counter bus 398 which is controlled by a conventional counter 400. When comparator 396 detects like values on the buses 394 and 398, its output conductor 402 is raised to a logical one state. This logical state controls the operation of the edit circuit as described later.

Local panel control of the parameter circuits is achieved by an adjustment circuit 406. VCO 16 is adjusted by a potentiometer 408 having a rotary slider 409 which serves as an input to an analog gate 410. Octave divider 20 is adjusted by a switch 412 operating between terminals 414, 415 which are inputs to a tristate buffer 417. The outputs of waveshape generator 24 are selected by a switch 420 operating between terminals 422, 423 which are inputs to a tristate buffer 425. VCF 32 is adjusted by a potentiometer 428 having a rotary slider 429 which serves as as input to an analog gate 431. Analog gates 410, 431 and buffers 417, 425 are controlled by taps 365, 371, 375 and 385 of ring counter 367. The VCO and VCF analog parameter signals are supplied to a conductor 433 through gates 410 and 431. The analog parameter signals are converted to digital form by an analog-to-digital converter 432.

Figure 9:
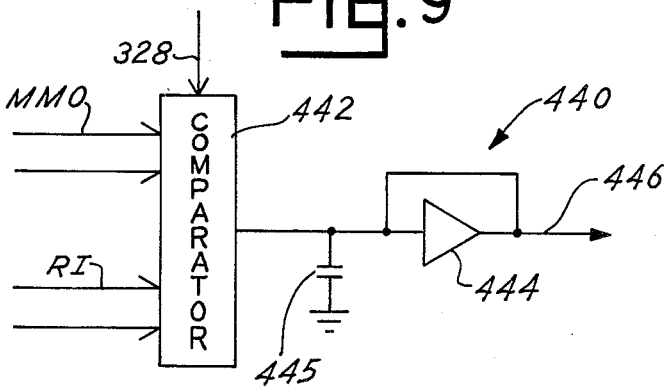
FIG. 9 is an electrical schematic diagram of a preferred form of adjustment indicator circuitry included in the routing control portion of FIG. 6.

The single edit embodiment also includes an adjustment indicator circuit 440. A portion of the circuit is included in routing control 357 and is shown in detail in FIG. 9. Circuit 440 includes a digital comparator 442 which is gated by the edit signal transmitted over conductor 328. The comparator compares the values of the digital signals on buses MMO and RI. As the comparator is strobed by the edit signal, the results of the comparison are stored by a sample and hold circuit comprising an operational amplifier 444, a storage capacitor 445 and an output conductor 446. Referring to FIG. 6, the remaining portion of adjustment indicator circuit 440 is contained in the control panel 70S and comprises a resistor 450, as well as inverse polarity connected light-emitting diodes (LED's) 448 and 449.

If the value of bus RI is greater than the value of bus MMO during the edit signal, LED 448 is lighted and LED 449 is unlighted, thereby indicating that the value of the local control adjustment is greater than the value received from memory. If the value on bus RI is less than the value on bus MMO during the edit signal, LED 449 is lighted and LED 448 is unlighted, thereby indicating that the value of the local control adjustment is less than the value received from memory. If the values on buses RI and MMO are identical, neither LED 448 or LED 449 is lighted, thereby indicating that the local panel control adjustment and the value received from memory are the same. This is an important feature which enables the performer to accurately set his local panel control to the same value as the memory, thereby expediting the editing process.

Referring to FIG. 10, routing control 357 interconnects the various buses in the manner shown. The interconnection of the buses by routing control 357 is summarized in TABLE 5.

TABLE 5

| Switch | Interconnections |
|---|---|
| RECALL | MMO → AMI, RO |
| EDIT | Normally MMO → RO. During edit signal, RI → AMI, RO |
| AUXILIARY ONLY | AMO → RO |
| NO PRESET | RI → RO |
| STORE | AMO → MMI |
| PROGRAM | MMO → RO |

The left hand column of TABLE 5 describes the various switches of the control panel (FIG. 7) and the right hand column describes the interconnection of the buses achieved by the routing control in response to the pushing of the control switches. The bus at the tail of the arrow is connected to each of the buses at the head of the arrow.

Referring to FIG. 10, routing control 357 includes AND gates 456–462, OR gates 465–468, NOR gate 470 and inverters 472–473 connected as shown. FIG. 10 shows the logic for only a single one of the conductors of multiconductor buses AMO, AMI, RO, RI and MMO. Duplicate circuitry would need to be provided for each of the other conductors in the buses. That is, the portion of FIG. 10 to the right of the vertical dotted line must be duplicated for each bit line of the buses.

The operation of the single edit embodiment will now be described with reference to FIGS. 6 and 7. Cooperation between clock generator 352 and ring counter 367 provides the synchronization required to transmit parameter signals to synthesizer 10 on a multiplex basis. This is an important feature which enables editing to proceed with only a single A-to-D converter, a single D-to-A converter, and a single adjustment indicator, thereby substantially reducing the cost of the system. Since clock generator 352 continually produces clock pulses, ring counter 367 produces output pulses successively on taps 365, 371, 375 and 385. After an output pulse is produced on tap 385, the ring counter resets so that an output pulse is again produced on tap 365 to start the next cycle of operation. As long as clock generator 352 is operating, ring counter 367 continues to produce cycles of output pulses in the manner described. The ring counter enables the parameter circuits to be supplied with updated parameter signals from bus RO or ROD in a sequential manner. Whether the parameter signals originate from memory of from local control panel 70S depends on the manner in which the performer operates entry keyboard 74.

For example, at certain times during the operation of the synthesizer, the performer may not want to avail himself of the capabilities of the editing feature, but merely will want to operate each of the parameter circuits from the local controls of panel 70S. In order to achieve this mode of operation, the operator depresses no preset switch 338 (FIG. 7). As a result, as shown in TABLE 5, routing control 357 connects bus RI to bus RO. When an output pulse is produced on tap 365, gate 410 transmits the voltage produced on slider 409 to analog conductor 433, and the voltage is converted to a digital value by converter 432. The digital value then is reconverted to analog form by converter 358 and is transmitted to analog gate 363 over conductor 359. Since tap 365 is producing an output pulse, gate 363 enables the value to be captured by sample and hold circuit 360 in order to operate VCO 16.

When tap 371 of ring counter 367 produces an enabling pulse, the logic state of switch 412 is transmitted through tristate buffer 417 to bus RID. This bus is connected to bus ROD through routing control 357 and is used to read the logic state into latch 370 in order to control divider 20. Waveshape generator gate 28 and VCF 32 are controlled in an analogous manner by tristate buffer 425 and potentiometer 428. As a result, the performer may control each of the parameter circuits by local panel control to the exclusion of any control by main memory 300.

If the performer decides to recall a preset group of parameter signals, edit those signals and store them in a different memory location, the following operations are performed. The recall memory location is entered on the entry keyboard and displayed on display units 170, 172 in the manner previously described. As soon as the recall switch 162 is depressed, the read address corresponding to the desired memory location is transmitted to address generator 350 over bus 55. The address generator contains an address counter which is set to the selected starting address of the preset group by the next clock pulse following receipt of the address. The same clock pulse generates a reset pulse over a conductor 366, so that ring counter 367 generates a pulse on tap 365. This operation coordinates the reading of the parameter signals from main memory with the operation of the ring counter in order to transmit the proper parameter signals to the proper parameter circuit. The address counter is indexed four times by clock generator 352 and is thereafter reset to the preselected starting address. This mode of operation results in the generation of the addresses for each of the four words of the preset group selected by the performer. This operation is needed because the four parameter signals required to operate the four parameter circuits are stored in four consecutive memory locations.

For example, if preset group 45 is recalled, the four parameter signals corresponding to the group may be stored in memory locations 100, 101, 102 and 103. Location 100 would store the VCO parameter signal, location 101 would store the divider parameter signal, location 102 would store the waveshape gate parameter signal and location 103 would store the VCF parameter signal. Each of these signals is read out of memory 300 cyclically and one-at-a-time. As soon as one cycle of read out is completed, another cycle begins due to the operation of the address counter in address generator 350.

As shown in TABLE 5, the parameter signals stored in main memory 300 are transmitted to the four memory locations in auxiliary memory 306 by means of the interconnection between buses MMO and AMI. In addition, the parameter signals are transmitted to bus RO where they are used to operate the parameter circuits in the manner previously described.

In the recall mode of operation, all of the parameter circuits are controlled from main memory and the operation of the local panel controls has no effect on the sound generated by the synthesizer. The sound is generated as soon as a key of keyboard 12 is depressed. Of course, at any time, the performer may depress no preset switch 338 which will transfer control to the local panel knobs in the manner previously described.

After recall switch 162 is depressed, the stored parameter signals controlling each of the parameter circuits may be edited, but must be edited one at a time. In order to achieve this mode of operation, the parameter desired to be edited is selected by parameter select knob 392. Thereafter, edit switch 322 is depressed. As shown in TABLE 5, this operation normally results in bus MMO being connected to bus RO. As a result, three out of the four parameter signals in the selected group are transmitted from memory to the parameter circuits. However, with respect to the chosen parameter signal being edited, control is transferred from the memory to panel 70S. This is achieved by the operation of counter 400 and comparator 396 (FIG. 6). When the address of the chosen parameter signal is about to be generated by generator 350, comparator 396 produces an edit signal in conductor 402 which is transmitted to routing control 357. In response to the edit signal, bus RI is connected to auxiliary memory bus AMI and to bus RO. As a result, the signal generated by the local control knob is transmitted to output bus RO, thereby enabling the parameter circuit to be controlled from panel 70S, rather than from the parameter signals stored in memory 300.

This mode of operation can be more clearly stated by means of an example based on the assumption that the selected group of parameter signals is stored at memory locations 100–103. Assuming the performer wants to edit the VCO parameter signal, he would set select knob 392 to the one position. This would result in comparator 396 being set to a one count. After the performer enters the digits 45 on the keyboard and depresses recall switch 162, the address counter within address generator 350 is set to 100, and counter 400 is set to a one count by means of the reset signal on conductor 366. At the same time, ring counter 367 is reset to its initial state. Since counter 400 and comparator 396 both are at a one count, comparator 396 generates an edit pulse on conductor 402 which is transmitted through AND gate 327 to routing control 357. In response to the edit signal, routing control 357 connects bus RI to bus AMI and bus RO. As a result, conductor 18 of VCO 16 is controlled from potentiometer 408, rather than the VCO parameter signal stored in memory 300 at location 100. The inherent delay in memory 300 prevents the stored parameter signal from being read before routing control 357 changes the interconnection of the buses. While counter 400 is at a one count, the digital information from converter 432 is read into the number one memory position of memory 306 on bus AMI. This is enabled by the generation of a write signal on conductor 308 which results from the edit signal generated by comparator 396.

During the second, third and fourth clock pulses from generator 352, counter 400 advances to counts other than one, and the edit signal is cancelled by comparator 396. As a result, routing control 357 connects bus MMO to bus RO, so that the divider, waveshape generator and VCF parameter circuits are all controlled from locations 101–103 in main memory 300. During the fifth pulse from generator 352, counter 400 is reset to a one count. As a result, during the fifth pulse from clock generator 352, counter 400 and the setting of parameter select control 392 are identical, and comparator 396 again produces an edit signal. Again, during the edit signal, VCO 16 is controlled by potentiometer 408, rather than memory location 100. The same cycles of operation continue as long as parameter select control knob 392 is in position one, so that the performer can edit the VCO parameter signal.

While editing is taking place, the high-low LED's 448 and 449 enable the performer to quickly adjust the position of slider 409 to coincide with the value stored in location 100 in main memory in the manner previously described in connection with FIGS. 1A and 1B. This is an important feature which enables multiple parameter signals to be edited from a single adjustment indicator circuit, thereby providing maximum adjustment convenience at minimum cost.

After the performer has edited one or more parameter signals from a selected group, he may wish to listen to the sound produced by the values originally contained in memory 300. In order to achieve this result, the performer merely depresses program switch 345. Routing control 357 then connects but MMO to bus RO (TABLE 5). This operation results in the control of the parameter circuits wholly from memory 300. By depressing the program switch a second time, flip-flop 343 (FIG. 8) is toggled to its original state, and operation is returned to the edit mode. As a result, the performer obtains a direct comparison between the edited and the originally stored version of the sound timbre produced by the synthesizer. This is an important feature which simplifies the editing process.

During editing process, the performer also may want to hear the total effect of various changes to the stored parameter signals. In order to achieve this result, he depresses auxiliary only switch 332. Routing control 357 then connects bus AMO to bus RO. As a result, the parameter circuits are controlled by the cummulative total of all the changes made and stored in auxiliary memory 306. This is an important feature which enables the performer to determine the cummulative total effect of all the changes to the parameter signals which he has been making one-at-a-time by means of the parameter select control knob 392.

The performer can easily tell which mode of operation he is in by observing light sources 324, 334, 340 and 344, which are located adjacent their associated switches on panel 70S.

After the performer has edited the preset parameter signals in the manner desired, he can store them in any desired memory location by entering the appropriate digits on entry keyboard 74 and by depressing store switch 142 in the manner previously described. Immediately, the selected storage location is displayed by display units 150, 152, and bus AMO is connected input bus MMI (TABLE 5). As a result of this operation, the signals in their edited form recorded in auxiliary memory 306 are cyclically read into main memory 300 in order to store them in the selected storage location. Thereafter, the performer may recall another preset group of parameter signals in order to operate the parameter circuits or edit the signals as desired.

Those skilled in the art will recognize that the two embodiments described herein may be modified and altered without departing from the true spirit and scope of the invention as defined in the appended claims. For example, the auxiliary memory may be part of the main memory by appropriate redesign of the address generator, routing control and ring counter.

What is claimed is:

1. In an electronic musical synthesizer including multiple parameter circuits capable of synthesizing a timbre of sound in response to stored parameter signals, improved apparatus for editing the parameter signals comprising:

adjustment means for generating an adjusted parameter signal suitable for replacing a chosen one of said stored parameter signals;

comparator means for generating an indicating signal having a value depending on the relative magnitude of the chosen parameter signal and adjusted parameter signal; and indicator means responsive to the indicating signal for indicating when the adjustment means has been adjusted to generate an adjusted parameter signal having a predetermined magnitude with respect to the chosen parameter signal.

2. Apparatus, as claimed in claim 1, wherein the comparator means comprises:

means for causing the indicating signal to have a first value when the adjusted parameter signal has a magnitude less than the magnitude of the chosen parameter signal and for causing the indicating signal to have a second value when the adjusted parameter signal has a magnitude greater than the magnitude of the chosen parameter signal; and wherein the indicator means comprises display means for providing a visual indication responsive to the first and second indicating signal values.

3. Apparatus, as claimed in claim 2, wherein the display means comprises:

first light means for producing illumination in response to the first indicating signal value; and second light means for producing illumination in response to the second indicating signal value, whereby an operator can conveniently adjust the adjusted and chosen parameter signals to the same value.

4. In an electronic musical synthesizer including multiple parameter circuits capable of synthesizing a timbre of sound in response to stored parameter signals, improved apparatus for editing the parameter signals comprising:

adjustment means for generating an adjusted parameter signal suitable for replacing a chosen one of said stored parameter signals;

comparator means for generating a first indicating signal when the adjusted parameter signal has a value less than the value of the chosen parameter signal and for generating a second indicating signal when the adjusted parameter signal has a value greater than the value of the chosen parameter signal;

first light means for producing illumination in response to the first indicating signal; and second light means for producing illumination in response to the second indicating signal, whereby an operator can conveniently adjust the adjusted and chosen parameter signals to the same value.

5. In an electronic musical synthesizer including multiple parameter circuits capable of synthesizing a timbre of sound defined by a set of parameters, improved apparatus for recalling, editing and restoring preset groups of parameter signals representing said parameters in order to improve the accuracy and speed with which different timbres of sound can be synthesized comprising:

memory means for storing at multiple memory locations different preset groups of said parameter signals, each preset group representing a predetermined timbre of sound, said memory means including means for reading signals from the memory means and writing signals into the memory means;

preset selection means for selecting a predetermined preset group of parameter signals defining a selected timbre of sound from among the different groups of said parameter signals stored in the memory means;

parameter selection means for selecting a chosen parameter signal from among the plurality of parameter signals in said predetermined preset group;

adjustment means for selecting from two or more possible signal values an adjusted parameter signal representing a suitable replacement for the chosen parameter signal;

edit means settable in a first state for enabling the parameter circuits to simultaneously respond to both the adjusted parameter signal and at least one of the parameter signals in the predetermined preset group other than the chosen parameter signal in order to produce an edited timbre of sound, and settable in a second state subsequent to the first state for enabling the parameter circuits to respond to the predetermined preset group of parameter signals, so that the edited and selected timbres of sound can be conveniently compared; and store enable means for generating a store signal and for enabling the storage of the value of the adjusted parameter signal by the memory means without operating the adjustment means to create replacements for parameter signals other than the chosen parameter signal, whereby the signals representing the edited timbre of sound can be stored for later recall.

6. In an electronic musical synthesizer including multiple parameter circuits capable of synthesizing a timbre of sound defined by a set of parameters, improved apparatus for recalling, editing and restoring preset groups of parameter signals representing said parameters in order to improve the accuracy and speed with which different timbres of sound can be synthesized comprising:

memory means for storing at multiple memory locations different preset groups of said parameter signals, each preset group representing a predetermined timbre of sound, said memory means including means for reading signals from the memory means and writing signals into the memory means;

preset selection means for selecting a predetermined preset group of parameter signals defining a selected timbre of sound from among the different groups of said parameter signals stored in the memory means;

parameter selection means for dividing the predetermined preset group into a chosen parameter signal and a plurality of unchosen parameter signals;

adjustment means adjustable in a first mode of operation for generating an adjusted parameter signal representing a suitable replacement for the chosen parameter signal and adjustable in additional modes of operation for generating additional parameter signals suitable for replacing the unchosen parameter signals, said adjusted parameter signal and unchosen parameter signals defining an edited timbre of sound;

edit means for enabling the synthesizer to alternate between a first state in which the parameter circuits respond to the adjusted parameter signal and the unchosen parameter signals while the chosen parameter is stored irrespective of the condition of the adjustment means in the additional modes of operation and a second state in which the parameter circuits respond to the predetermined preset group of parameter signals while the adjusted parameter signal is stored, so that the edited and selected timbres of sound can be conveniently compared without laborious manipulation of the adjustment means; and store enable means for generating a store signal and for enabling the storage of the value of the adjusted parameter signal by the memory means, whereby the signals representing the edited timbre of sound can be stored for later recall.

7. Apparatus, as claimed in claims 5 or 6, and further comprising indicator means for indicating when the adjustment means has been adjusted to generate an adjusted parameter signal having a predetermined relationship with respect to the chosen parameter signal.

8. Apparatus, as claimed in claim 7, wherein the indicator means comprises:

comparator means for generating a first indicating signal when the adjusted parameter signal has a value less than the value of the chosen parameter signal and for generating a second indicating signal when the adjusted parameter signal has a value greater than the value of the chosen parameter signal; and display means for providing a visual indication responsive to the first and second indicating signals.

9. Apparatus, as claimed in claim 8, wherein the display means comprises:

first light means for producing illumination in response to the first indicating signal; and second light means for producing illumination in response to the second indicating signal, whereby an operator can conveniently adjust the adjusted and chosen parameter signals to the same value.

10. Apparatus, as claimed in claim 8, wherein the parameter selection means comprises a separate parameter control for each parameter signal in the predetermined preset group of parameter signals, wherein the adjustment means is manually adjustable and comprises a separate adjustment control for each parameter control, and wherein the display means comprises a separate display device for each parameter control, whereby each parameter of a preset group can be individually adjusted.

11. Apparatus, as claimed in claim 10, wherein the memory means comprises means for storing a local control signal, and wherein one of the separate parameter controls is responsive to the local control signal to prevent operation by a parameter signal stored in the memory means and to enable operation by the corresponding adjustment control.

12. Apparatus, as claimed in claims 5 or 6, wherein the memory means comprises:

main memory means for storing a plurality of said preset groups in digital form at said multiple memory locations; and auxiliary memory means for storing at least said predetermined preset group in predetermined memory positions while said predetermined preset group is being recalled or edited.

13. Apparatus, as claimed in claim 12, and further comprising auxiliary select means for generating an auxiliary signal and for enabling the parameter circuits to produce the timbre of sound corresponding to a group of parameter signals stored in the auxiliary memory means.

14. Apparatus, as claimed in claim 13, wherein the edit means comprises:

address generator means for generating address signals enabling the predetermined preset group to be read out of the main memory means and stored in the auxiliary memory means in response to the selection of the predetermined preset group, enabling the adjusted parameter signal to be substituted for the chosen parameter signal in the auxiliary memory means in response to the selection of the chosen parameter, enabling a designated group of said parameter signals to be read out of the auxiliary memory means in response to the auxiliary signal and for enabling a designated group of said parameter signals to be read out of the auxiliary memory means and stored in said main memory means in response to the store signal;

conversion means for converting the parameter signals into a form usable by the parameter circuits; and control means for transmitting the predetermined preset group to the conversion means in response to the selection of the predetermined preset group, for transmitting the adjusted parameter signal to the conversion means in response to the selection of the chosen parameter, and for transmitting the designated group of said parameter signals to the conversion means in response to the auxiliary signal.

15. Apparatus, as claimed in claim 14, wherein the parameter selection means comprises means responsive to manual actuation for selecting one-at-a-time a plurality of chosen parameter signals corresponding to a plurality of said parameter circuits.

16. Apparatus, as claimed in claims 5 or 6, wherein the adjustment means comprises means for increasing and decreasing the value of the adjusted parameter signal.

17. Apparatus, as claimed in claim 16, wherein the adjustment means comprises means for generating a series of adjusted parameter signals having a multiplicity of values.

18. A method of operating an electronic musical synthesizer capable of producing different timbres of sounds defined by a plurality of parameters capable of being represented by parameter signals, the method comprising the steps of:

storing in a first memory location a plurality of groups of parameter signals, each said group representing the parameters needed to define a predetermined timbre of sound;

selecting a predetermined group of parameter signals from among said plurality of groups;

operating the synthesizer by means of the stored predetermined group of parameter signals in order to produce a sound having a first timbre;

generating an adjusted parameter signal representing a modification of a chosen parameter signal, the chosen parameter signal being one of the parameter signals in said predetermined group;

operating the synthesizer by means of an adjusted group of parameter signals comprising the predetermined group in which the adjusted parameter signal is substituted for the chosen parameter signal, whereby a sound having an adjusted timbre is produced;

continuing to store the chosen parameter signal while the synthesizer is being operated by means of the adjusted group of parameter signals; and storing the adjusted parameter signal as part of the predetermined group of parameter signals, so that the adjusted timbre of sound can be quickly and accurately produced by recalling the predetermined group, including the adjusted parameter signal, from storage.

19. A method, as claimed in claim 18, wherein the step of operating the synthesizer by means of the stored predetermined group comprises the steps of:

storing the predetermined group of parameter signals in an auxiliary memory location, as well as the first memory location; and converting the predetermined group to a form usable by the synthesizer.

20. A method, as claimed in claim 19, wherein the step of operating the synthesizer by means of an adjusted group of parameter signals comprises the steps of:

substituting the adjusted parameter signal for the chosen parameter signal within the auxiliary memory location; and converting the adjusted group of parameter signals into a form usable by the synthesizer.

21. A method, as claimed in claim 20, wherein the step of storing the adjusted parameter signal comprises the steps of:

storing the adjusted group of parameter signals at a memory location other than the auxiliary memory location; and removing the adjusted group of parameter signals from the auxiliary memory location.

22. A method, as claimed in claim 18, and further comprising the step of providing an indication when the adjusted parameter signal attains a predetermined relationship with respect to the chosen parameter signal.

23. A method, as claimed in claim 22, wherein indication is a visual indication.

24. A method, as claimed in claim 18, and further comprising the step of:

alternating between the step of operating the synthesizer by means of the stored predetermined group of parameter signals and the step of operating the synthesizer by means of an adjusted group of parameter signals, whereby a direct comparison between the first timbre and the adjusted timbre can be made.

* * * * *